US005769264A

United States Patent [19]

Lipkowitz

[11] Patent Number: 5,769,264

[45] Date of Patent: Jun. 23, 1998

[54] WINE TASTING PALLET

[75] Inventor: John M. Lipkowitz, Las Vegas, Nev.

[73] Assignee: Rio Properties, Inc., Las Vegas, Nev.

[21] Appl. No.: 819,518

[22] Filed: Mar. 17, 1997

[51] Int. Cl.[6] ..... B65D 25/28

[52] U.S. Cl. ..... 220/575; 220/23.83; 220/914; 220/556; 294/143; 294/144

[58] Field of Search ..... 294/144, 143, 294/172; 220/23.8, 23.83, 23.86, 914, 574, 575, 556

[56] References Cited

U.S. PATENT DOCUMENTS

| | | | |
|---|---|---|---|
| D. 54,971 | 4/1920 | Thompson . | |
| D. 87,682 | 8/1932 | Porter . | |
| D. 182,396 | 4/1958 | Berry, Jr. . | |
| D. 194,114 | 11/1962 | Graham . | |
| D. 208,566 | 9/1967 | Lawler . | |
| D. 251,102 | 2/1979 | Box . | |
| D. 293,190 | 12/1987 | Flanagan, Sr. . | |
| D. 296,404 | 6/1988 | Lowenbein . | |
| D. 305,192 | 12/1989 | van Erkel . | |
| D. 308,461 | 6/1990 | Hosea . | |
| D. 331,860 | 12/1992 | Stanfield . | |
| D. 359,885 | 7/1995 | Yanuzzi . | |
| D. 364,072 | 11/1995 | Keable . | |
| D. 366,598 | 1/1996 | Geddes . | |
| 1,071,705 | 9/1913 | Collins | 294/144 |
| 1,370,811 | 3/1921 | Harding | 294/144 |
| 1,659,344 | 2/1928 | Wissman | 294/144 |
| 3,315,858 | 4/1967 | Horner . | |
| 3,504,832 | 4/1970 | Corvetti . | |
| 3,941,286 | 3/1976 | Perkinson . | |
| 4,516,685 | 5/1985 | French . | |
| 4,732,274 | 3/1988 | Bouton | 294/143 |
| 4,961,555 | 10/1990 | Egan, Jr. . | |
| 5,076,438 | 12/1991 | Aronson . | |
| 5,294,000 | 3/1994 | Yanuzzi . | |
| 5,390,798 | 2/1995 | Yanuzzi . | |
| 5,419,455 | 5/1995 | Russeau . | |
| 5,607,077 | 3/1997 | Torkelson | 220/575 |

FOREIGN PATENT DOCUMENTS

| | | | |
|---|---|---|---|
| 2572915 | 5/1986 | France | 294/144 |
| 98116 | 7/1898 | Germany | 294/144 |
| 2100326 | 7/1972 | Germany | 294/172 |
| 1126304 | 9/1968 | United Kingdom . | |

*Primary Examiner*—Stephen J. Castellano
*Attorney, Agent, or Firm*—Quirk & Tratos

[57] ABSTRACT

A pallet for holding food items and wine goblets in one hand is provided. The pallet has a body with a top surface for placing food items. At one end there is a post and at the other end a brace, both extending from the underside of the body. The brace rests on the forearm and the post is held in the hand to hold and support the pallet. Keyhole slots are provided to hold wine goblets.

5 Claims, 5 Drawing Sheets

WINE TASTING PALLET

FIELD OF THE INVENTION

The present invention relates to devices for holding and stabilizing a platform for retaining items such as food items and beverage goblets.

BACKGROUND OF THE INVENTION

At parties where food and beverage items are being served, it is difficult for a guest to hold a plate with food and a beverage. Often the only solution is for the guest to use both hands, one holding the plate and the other holding the beverage goblet. With both hands being occupied, the guest must set down one or the other of the plate and goblet to shake hands, open doors, load food items onto the plate or pour a beverage into the goblet. Otherwise a guest must exhibit their dexterity by attempting to hold the plate and goblet in the same hand and use the free hand for the aforementioned tasks. Sometimes attempts at this dexterity leads to spills and other accidents.

There has been suggestions in the prior art of devices by which a guest can hold a plate and goblet in one hand, leaving the other hand free. One suggestion is shown in Streames, UK Patent No. 1,126,304 which shows a thin serving tray having a one end a key hole slot to hold a beverage goblet and at the other end a thumb hole. The user places their thumb through the thumb hole to the upper side of the tray and supports the bottom on the tray with the remaining fingers of the hand. Thus the serving tray is quite similar to a painter's pallet.

Another suggested approach is described in Egan, Jr. U.S. Pat. No. 4,961,555 which shows a glass holder attachable to the side of a plate for holding a beverage goblet.

In the approaches described above and in other prior art attempts to solve the problems noted above, the serving tray is not adapted to be held in a convenient, comfortable and stable manner. The guests would typically hold the tray in such a manner as to impose a cantilever load on the wrist or to simply support the underside of the plate or tray with the hand in a supinated (palm up) position. Over extended periods of time, the rotation of the forearm to place the palm in a supinated position can be tiring. Furthermore, in comparison to the normal position of the palm of the hand, the supinated position is relatively unnatural.

There is, therefore, a need for a pallet which overcomes the problems noted above and is adapted to conveniently hold items such as food and beverage goblets in a manner that is comfortable as well as stable.

SUMMARY OF THE INVENTION

There is set forth, according to the present invention, a pallet adapted to be used at party gatherings having a body with a first end and a second end, a top surface for holding the food items and a bottom surface. A post depends from the bottom surface of the body proximate the first end and is adapted to be grasped with the palm of the hand substantially in a vertical position, i.e. not supinated or pronated. Spaced from the post is a brace which likewise depends from the bottom surface of the body and is adapted to rest upon the user's forearm between the elbow and wrist. At the first end keyhole slots are provided for holding beverage goblets.

The pallet according to the present invention overcomes the problems of cantilever loading on the wrist as well as the unnatural holding positions with the palm in the supinated or pronated positions. The pallet according to the present invention spreads the loading of the pallet and the food items and beverage goblets carried thereon over the forearm and hand and stabilizes the body between the upper forearm and hand.

BRIEF DESCRIPTION OF THE DRAWINGS

These and other features and advantages will become appreciated as the same becomes better understood with reference to the specification, claims and drawings wherein:

DESCRIPTION

Figure 2:
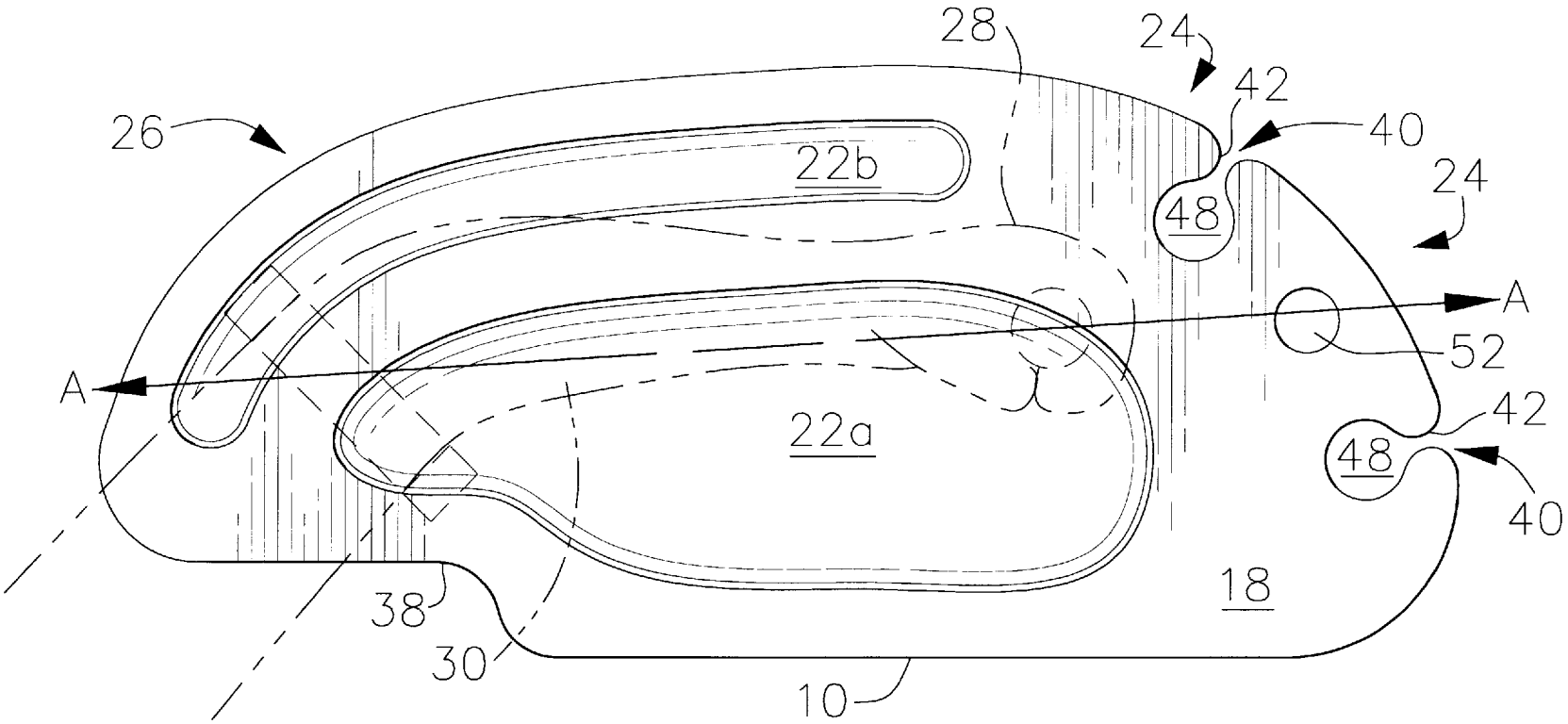
FIG. 2 is a top view.
Figure 3:
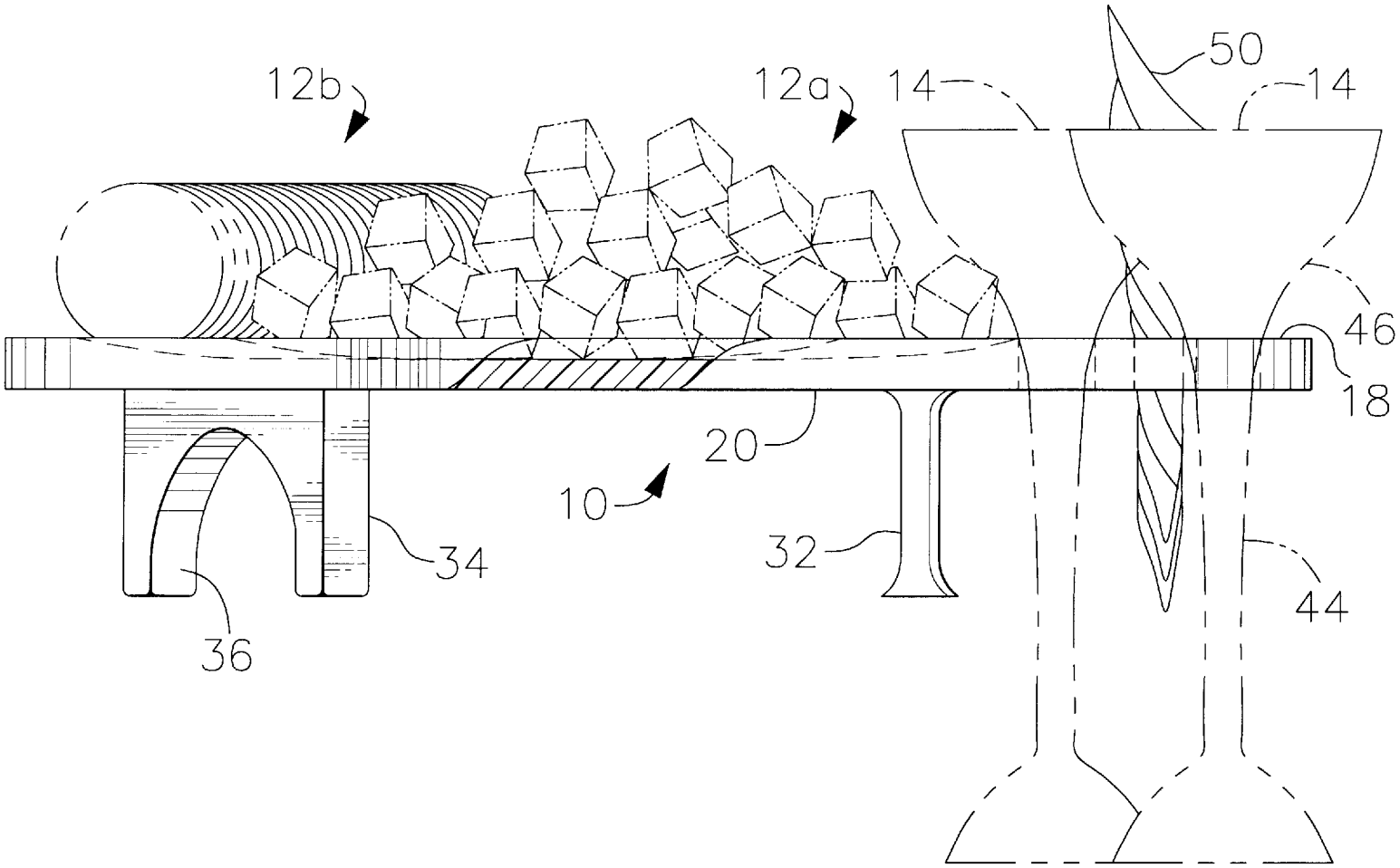
FIG. 3 is a side view of the pallet.

With reference to the drawings, there is shown a pallet 10 according to the present invention adapted, as hereinafter described, to hold food items 12*a,b* and beverage goblets 14 at gatherings such as parties, wine tasting parties, receptions and the like. The pallet 10 includes a generally planar body 16 having a top surface 18 and bottom surface 20. As shown in FIGS. 1–3, the top surface 18 may be fashioned with depressions 22*a,b* for conveniently confining food items placed on the top surface 18. By providing by the depressions 22*a,b* juices and other liquids of the food items will tend not to run together. Depression 22*b* may be elongated as shown to hold items such as round crackers 12b and the like. As can be appreciated, the pallet 10 may have any number, shape or orientation of depressions to accommodate food items and additionally or alternatively, provide a fanciful surface for the pallet 10.

The bottom surface 20 may be any suitable shape but for purposes of illustration is shown as flat in the drawings.

The pallet 10 has a first end 24 and second end 26. As will become appreciated, the first end 24 will be positioned over the user's hand 28 whereas the second end 26 will be over the user's forearm 30.

Depending from the bottom surface 20 at the first end 24 is a post 32. The post 32 extends substantially orthogonally from the bottom surface 20 to be received and held by the palm of the hand with the palm in substantially a vertical position as shown in FIG. 1. That is when the hand grasps the post 32 in, for example, a clenched fist, the palm will be in a vertical orientation and not supinated or pronated. As shown the post 32 may be contoured to easily fit within the clenched palm.

Figure 4:
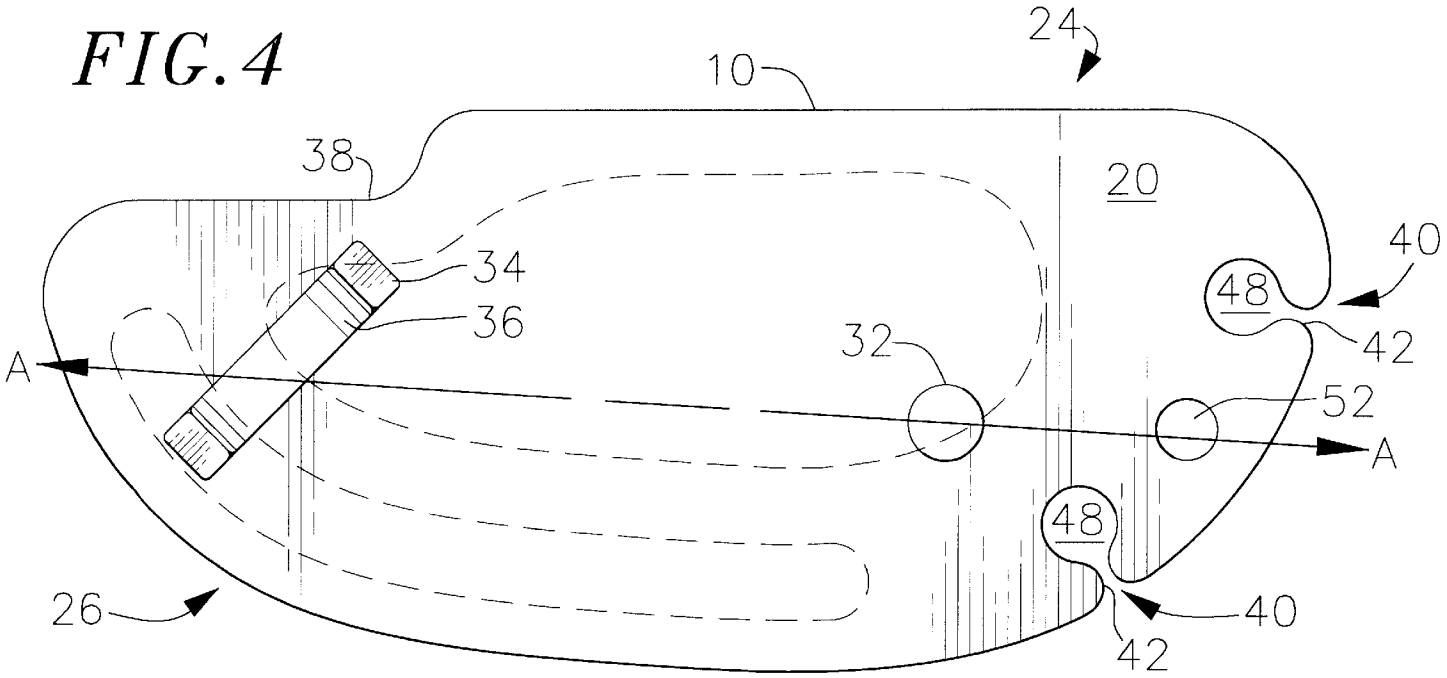
FIG. 4 is a bottom view of the pallet of FIG. 1.
Figure 5:
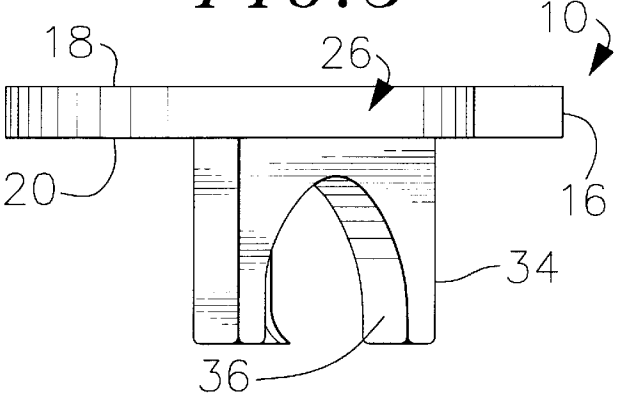
FIG. 5 is a rear end view of the pallet.
Figure 6:
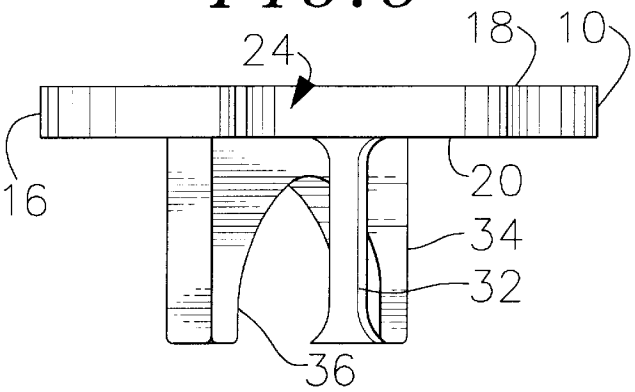
FIG. 6 is a front end view of the pallet.

Spaced from the post 32 at the second end 26 and likewise depending from the bottom surface 16 is a brace 34. As shown, brace 34 is planar and, opposite the bottom surface 20, includes an arcuate cutout defining a cradle 36 to cradle and mate with the user's forearm 30 proximate the elbow. As can further be seen with reference to FIG. 4, the brace 34 and its cradle 36 are fashioned at an angle to an axis A (FIGS. 2 and 4) for the pallet 10. The canting of the brace 34 relative to the axis A enables the user to comfortably position the cradle 36 over the forearm 30 and enables the pallet 10 to accommodate both large and small forearms.

With reference to FIG. 3 it can be seen that the post 32 and brace 34 define legs for the pallet 10. Accordingly, the pallet

10 may be set down on a table, standing on the post 32 and brace 34. While not shown, the post 32 and brace 34 may be collapsible to accommodate stacking of the pallets 10 on top of each other.

Figure 1A:
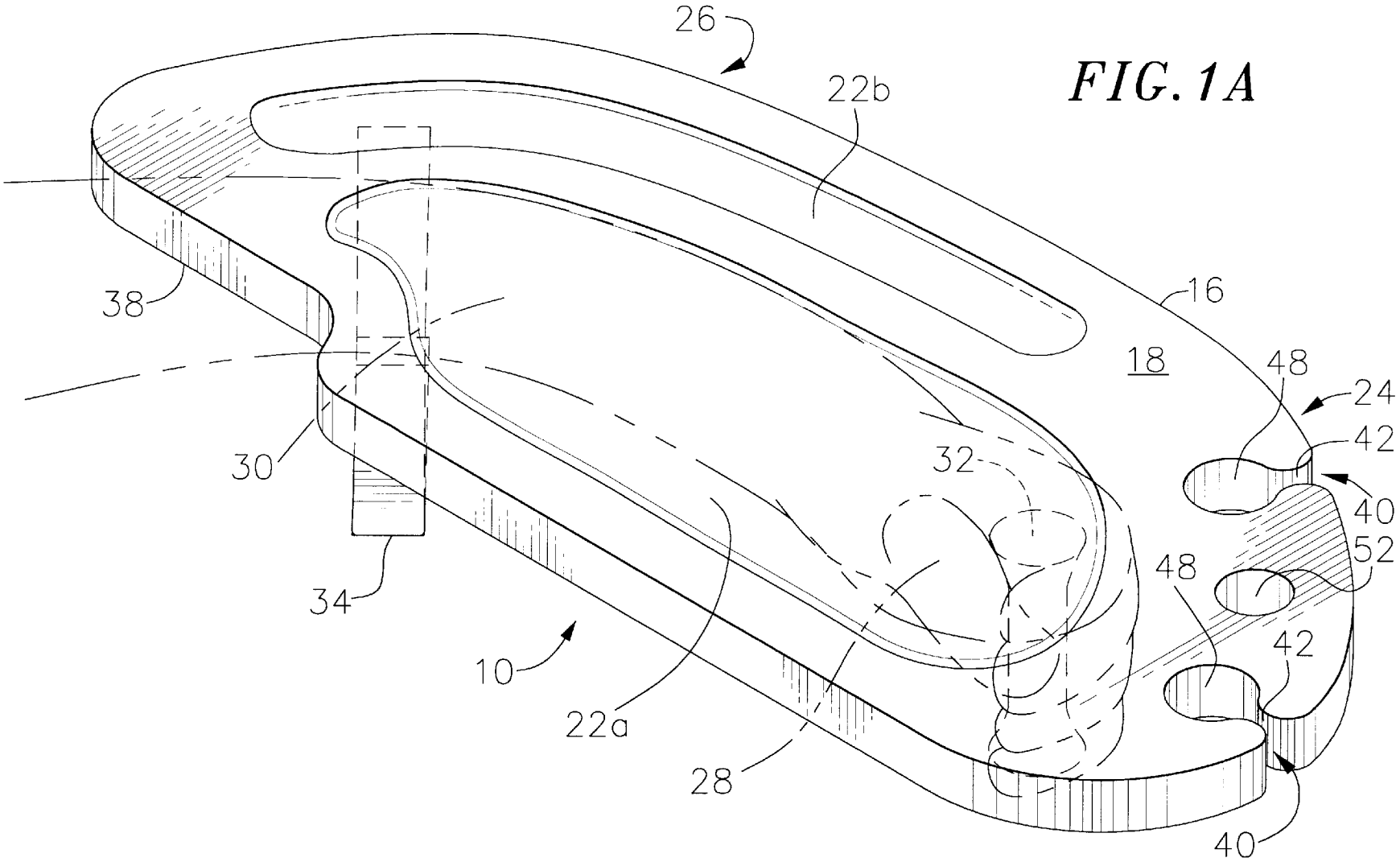
FIG. 1A is a top perspective view of a pallet according to the present invention shown being held in the hand.
Figure 1B:
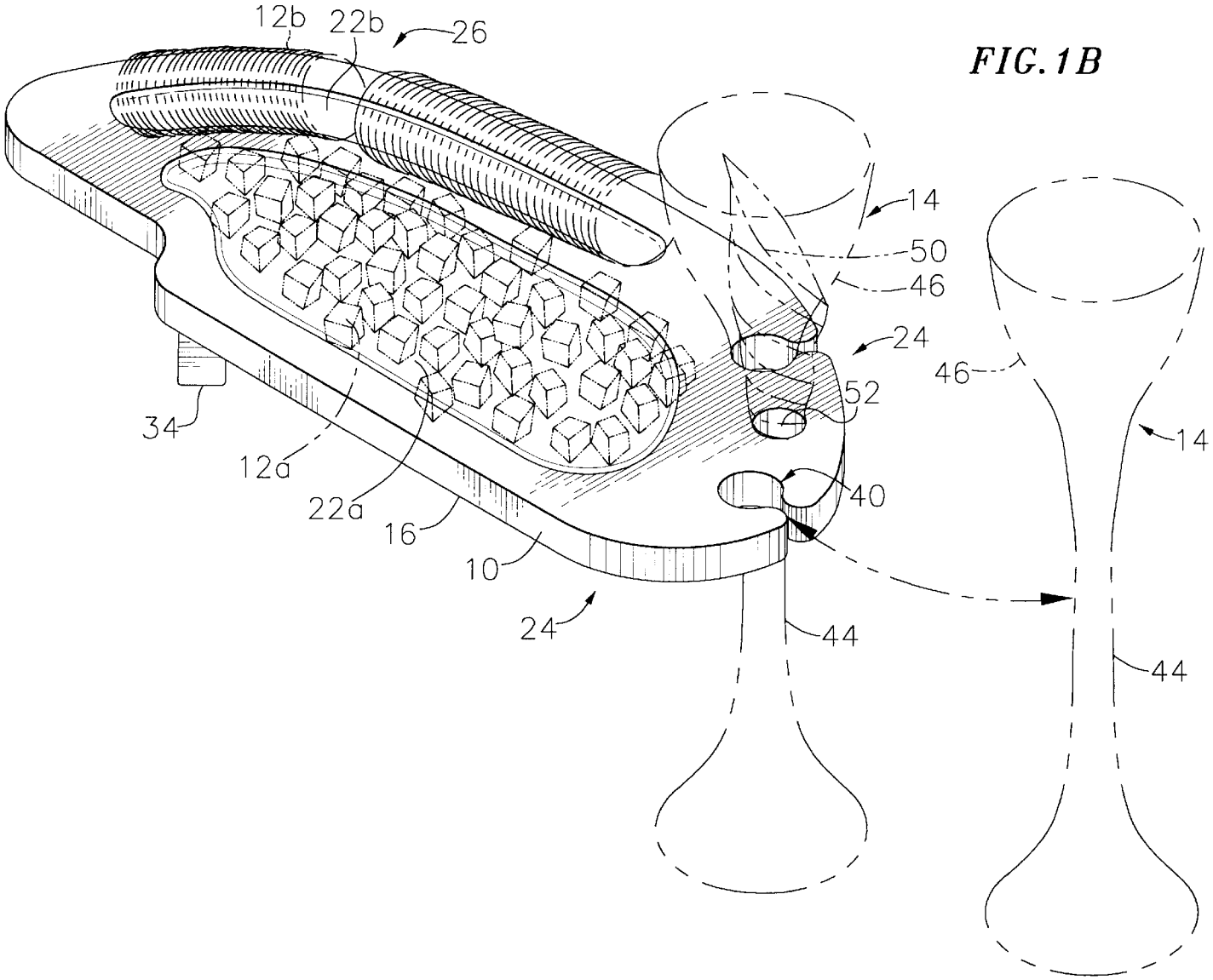
FIG. 1B is a top perspective view of the pallet shown holding food items, a goblet and a napkin.

To hold the pallet 10, the user picks up the pallet 10, bends their elbow and grasps the post 32 positioning the cradle 36 over their forearm 30 proximate the elbow as shown in FIG. 1A. With the elbow bent, the top surface 18 is substantially horizontal to support food items 12*a,b*. Furthermore, as described above, the palm of the hand 28 is in a comfortable, natural, vertical position grasping the post 32. To further support the pallet 10, the body 16 includes a recess 38 at the second end 26 to comfortably pass the user's upper arm as she/he holds the pallet 10. The canting of the brace 34 enables the user to comfortably wedge and position their forearm 30 into the cradle 36.

To hold beverage goblets 14, the pallet 10 may be provided with one or more keyhole slots 40 fashioned in the perimeter of the pallet body 16. Each of the slots 40 includes a narrow passageway 42 to pass the stem 44 of a goblet 14 to position the bowl 46 of the goblet 14 to rest in an enlarged opening 48. The user of the tray slides the goblet stem 44 through the passageway 42 and thereafter lowers the goblet 14 such that its bowl 46 rests on the body 16 in the opening 48.

To hold other items such as a rolled napkin 50 or the like, the pallet 10 may also be provided with a bore 52.

As can be appreciated, the pallet 10 according to the present invention provides a comfortable and stable platform for holding food items and goblets with one hand. The post 32 and brace 34 cooperate to spread the load of the pallet 10 onto the hand 28 and forearm 30 resulting in less fatigue. Furthermore, the cooperation between the post 32 and cradle 36 enable the user's palm to be in a comfortable and natural vertical position for holding of the pallet 10.

The pallet 10 may be fashioned from wood, plastic or paper products such as a sturdy cardboard.

While I have shown and described the preferred embodiment of the present invention it is to be understood that it is subject to many modifications without departing from the spirit and scope of the claims presented herein.

I claim:

1. A pallet for use at party gatherings comprising:

a planar body having a first end and a second end, a top surface for holding items and a bottom surface;

a brace depending from the bottom surface proximate the second end adapted to rest upon the user's forearm between the elbow and wrist; and a post depending from the bottom surface proximate the first end and adapted to be grasped with the palm of the hand substantially vertical, the brace and post extending substantially the same distance from the bottom to cooperate to define a stand for the body.

2. A pallet for holding food items and drink goblets comprising:

a body having a first end and a second end, a top surface for holding food items and a bottom surface, said body having at the first end a slot adapted to receive and hold a goblet of the type having a bowl joined to a smaller diameter stem, the slot including an enlarged opening to mate with and retain the bowl of the goblet and a passageway extending from the perimeter of the body to intersect the opening to pass the stem of the goblet to position the bowl in the opening;

a brace depending from the bottom surface proximate the second end adapted to rest upon the user's forearm between the elbow and wrist; and a post depending from the bottom surface proximate the first end and adapted to be grasped with the palm of the hand substantially vertical.

3. The pallet of claim 2 wherein the brace includes an arcuate cradle opposite the body to receive and mate with the forearm.

4. The pallet of claim 3 wherein the spacing between the post and brace are such that when the post is grasped the cradle rests on the forearm near the elbow.

5. The pallet of claim 2 wherein the body includes a recess proximate the second end to accommodate the upper arm when the pallet is positioned on the forearm.

* * * * *